US006206642B1

(12) United States Patent
Matheny et al.

(10) Patent No.: US 6,206,642 B1
(45) Date of Patent: Mar. 27, 2001

(54) COMPRESSOR BLADE FOR A GAS TURBINE ENGINE

(75) Inventors: Alfred P. Matheny, Jupiter; Richard A. Holmes, Tequesta; Wendell V. Twelves, Jr., Stuart, all of FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/213,696

(22) Filed: Dec. 17, 1998

(51) Int. Cl.[7] ..... F01D 5/14

(52) U.S. Cl. ..... 416/230; 416/229 A; 416/224; 415/173.3; 415/173.4; 415/173.5

(58) Field of Search ..... 415/173.1, 173.3, 415/173.4, 173.5; 416/224, 230, 231 B, 229 R, 229 A

(56) References Cited

U.S. PATENT DOCUMENTS 5,234,318 * 8/1993 Brandon ..... 416/192
5,522,698 * 6/1996 Butler et al. ..... 415/170.1
5,628,622 * 5/1997 Thore et al. ..... 416/241 R
5,735,667 * 4/1998 Sanders et al. ..... 415/170.1
5,752,802 * 5/1998 Jones ..... 415/170.1

* cited by examiner

*Primary Examiner*—Edward K. Look
*Assistant Examiner*—Ninh Nguyen
(74) *Attorney, Agent, or Firm*—Christopher T. Hayes

(57) ABSTRACT

A compressor blade that has a blade root, an airfoil having a first end, and a second end opposite the first end, the second end having at least one edge, and the airfoil is made of a first material having a first modulus of elasticity. A blade platform connects the blade root to the first end of the airfoil, and a flexible seal is connected to the airfoil adjacent the second end, and the seal is made of a second material having a modulus of elasticity that is substantially less than the first modulus of elasticity.

5 Claims, 5 Drawing Sheets

COMPRESSOR BLADE FOR A GAS TURBINE ENGINE

TECHNICAL FIELD

This invention relates to rotor blades for used in gas turbine engines, and more specifically blades used in the compressor of such engines.

BACKGROUND OF THE INVENTION

The performance of gas turbine engines, particularly those used to power fighter aircraft, can be detrimentally impacted by several factors. One of these factors is referred to as "tip clearance", which is the gap between the rotating blades and engine case that surrounds the rotating blades. Overall engine performance is particularly sensitive to tip clearance in the compressor section of the engine.

A certain amount of tip clearance is required to accommodate relative movement between compressor blades and the engine case under engine conditions such as surge, aircraft maneuvers, and differences in thermal expansion between the engine rotor and the engine case during engine acceleration and deceleration which decrease the gap. Gas turbine engines typically include outer air seals which are located in the engine case radially outward of each of the rotors. These outer air seals are usually made of an ablative material that is softer than the material on the tips of the blades, so that if the tip of a rotating blade contacts, or "rubs", the outer air seal, the outer air seal becomes sacrificial and the blade tip sustains little or no damage.

While outer air seals provide protection against blade damage and wear, when a blade tip rubs and grinds away part of the outer air seal, tip clearance increases. Unfortunately, as tip clearance increases, engine performance decreases. Over time, the accumulation of compressor blade tip rubs against the outer air seals can cause substantial deterioration of engine performance.

What is needed is a compressor blade that is capable of multiple rubs with the outer air seal, or the engine case, with no significant increase in tip clearance.

SUMMARY OF THE INVENTION

It is therefore an object of the present invention to provide a compressor blade that is capable of multiple rubs with the outer air seal, or the engine case, with no significant increase in tip clearance.

Accordingly, a compressor blade is disclosed having a blade root, an airfoil having a first end, and a second end opposite the first end, the second end having at least one edge, and the airfoil is made of a first material having a first modulus of elasticity. A blade platform connects the blade root to the first end of the airfoil, and a flexible seal is connected to the airfoil adjacent the second end, and the seal is made of a second material having a modulus of elasticity that is substantially less than the first modulus of elasticity.

The foregoing and other features and advantages of the present invention will become more apparent from the following description and accompanying drawings.

BEST MODE FOR CARRYING OUT THE INVENTION

Figure 1:
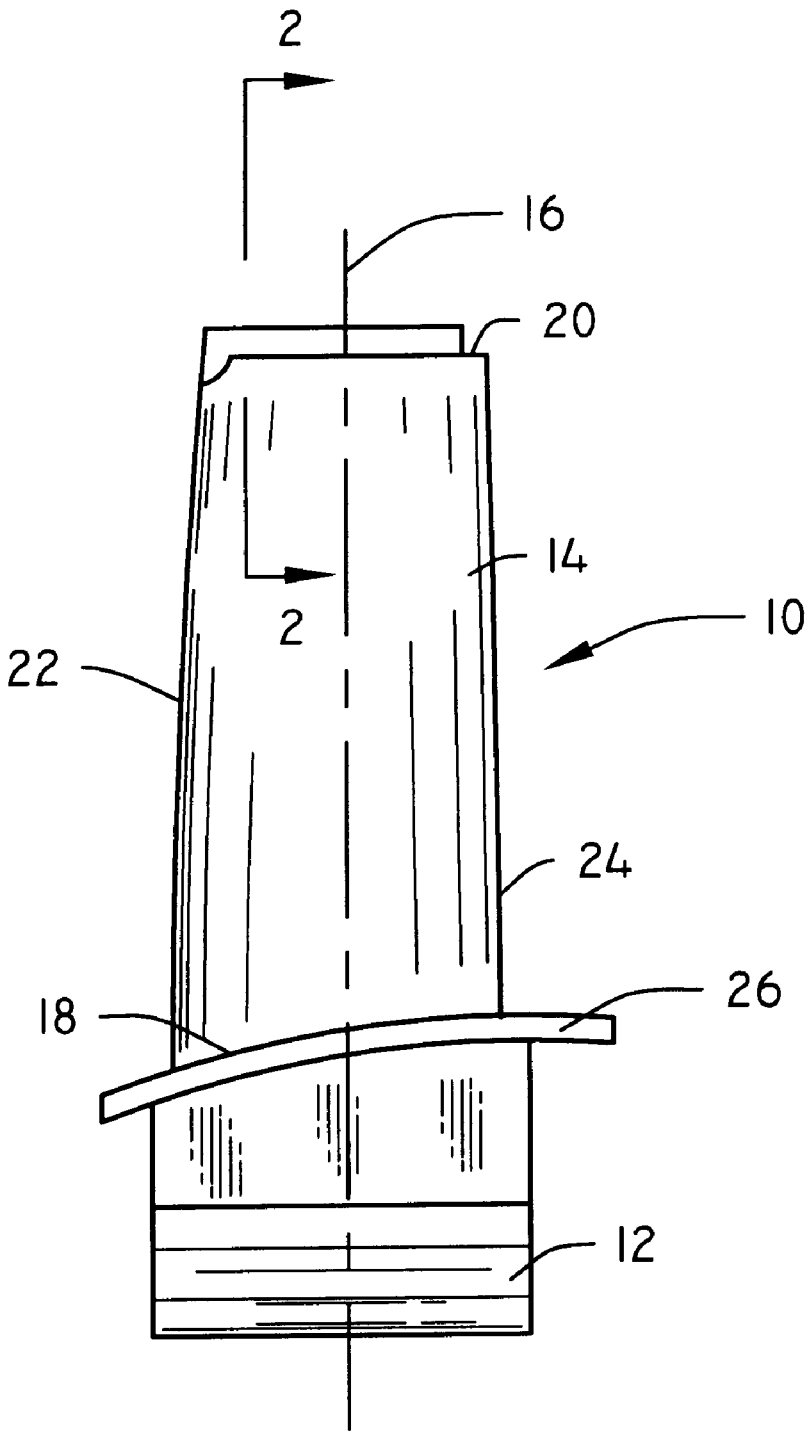
FIG. 1 is a plan view of the blade of the preferred embodiment of the present invention

As shown in FIG. 1, the compressor blade 10 of the present invention includes a blade root 12, and an airfoil 14 having a reference axis 16 defined therethrough. The airfoil 14 extends along the reference as 16 and has a first end 18 proximate the blade root 12, and a second end 20 opposite the first end 18. The leading edge 22 of the airfoil 14, and the trailing edge 24 of the airfoil 14, extend along the axis 16 as well. A blade platform 26 connects the blade root 12 to the first end 18 of the airfoil 14 and is integral with the airfoil 14 and blade root 12. The airfoil 14, blade platform 26 and blade root 12 are made of a material having a high modulus of elasticity, such as Inconel 100.

Figure 2:
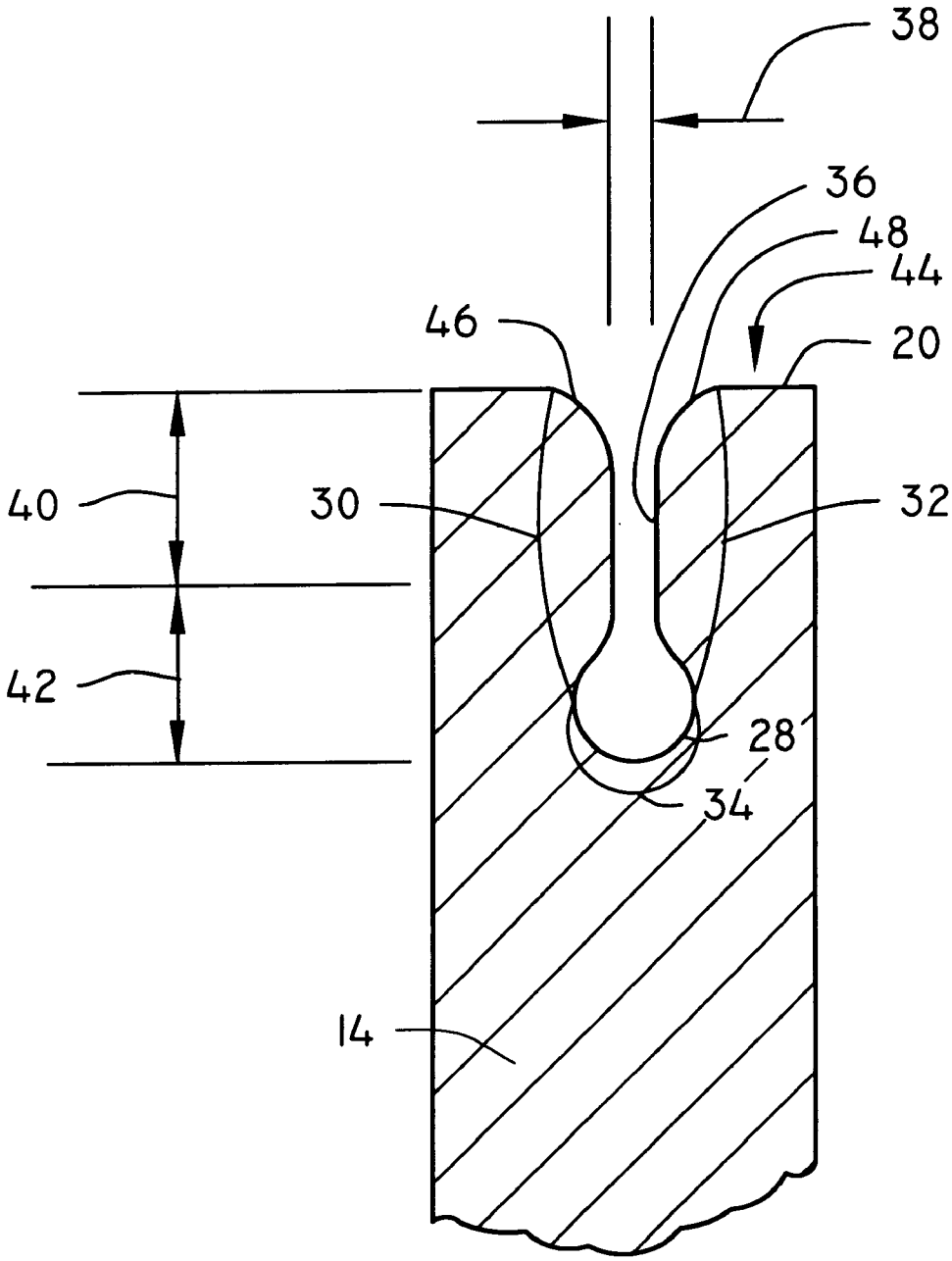
FIG. 2 is a partial cross-sectional view of the preferred embodiment of the present invention taken along line 2—2 of FIG. 1, with the flexible seal removed from the channel.

In the preferred embodiment of the present invention, the airfoil 14 includes a channel 28 adjacent the second end 20, as shown in FIG. 2. The channel 28 extends from immediately adjacent the leading edge 22 towards the trailing edge 24, and preferably terminates short of the trailing edge 24. The channel 28 includes a first side wall 30, and a second side wall 32 opposite the first side wall 30.

A bottom wall 34 connects the first and second side walls 30, 32. The channel 28 includes a throat 36 that defines the portion of the channel 28 where the distance 38 between the first and second side walls 30, 32 is minimum. The portion of the channel 28 between the throat 36 and the second end 20 defines a first channel portion 40, and the portion of the channel 28 between the throat 36 and the bottom wall 34 defines a second channel portion 42.

In the first channel portion 40, the first and second side walls 30, 32 converge toward the throat 36, and increasingly diverge toward the second end 20, so that the first and second side walls 30, 32 become essentially tangential to the surface 44 that defines the second end 20. The first side wall 30 in the first portion 40 defines a first radiused edge 46, and the second side wall 30 in the first portion 40 defines a second radiused edge 48. As used herein, the term "radiused edge" means that a first surface, such as the channel side wall, is connected to a second surface, such as the second end of the airfoil, by a third surface having a radius of curvature that is greater than zero, and preferably, is no less than 25 percent of the minimum distance 38. In the second channel portion 42, the first and second side walls 30, 32 converge toward the throat 36, and diverge toward the bottom wall 34, so that the channel 28 has a cross-section that forms a "keyhole", as shown in FIG. 2.

Figure 4:
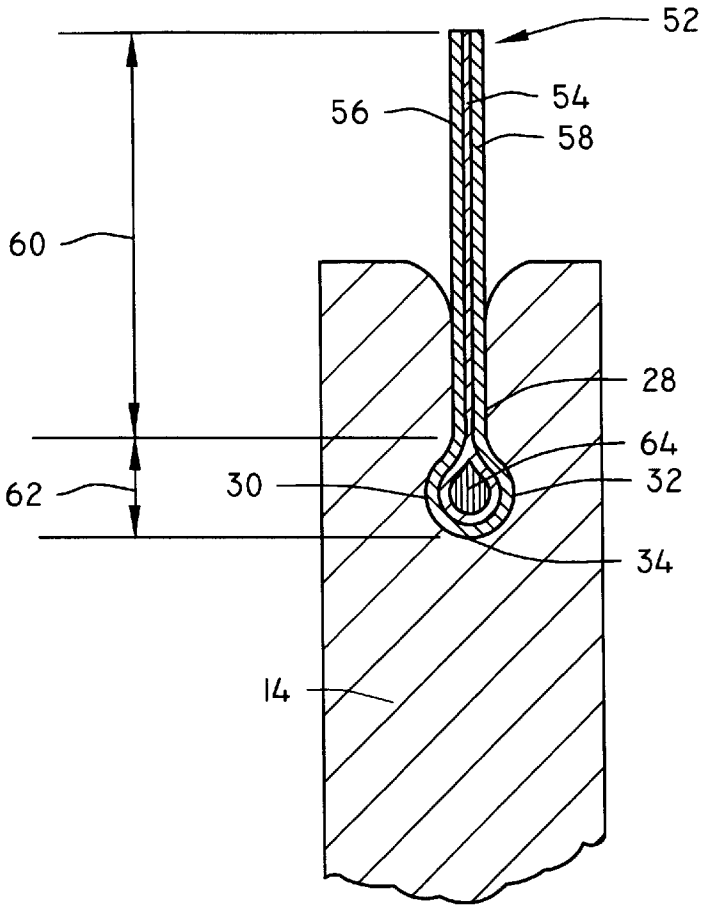
FIG. 4 is the partial cross-sectional view of FIG. 2 with the flexible seal located in the channel.
Figure 3:
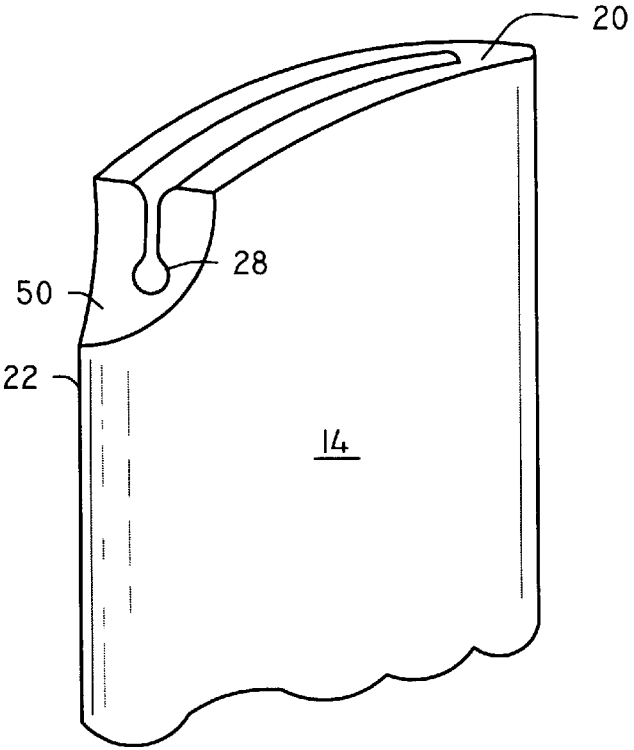
FIG. 3 is a perspective view of the preferred embodiment of the present invention showing that channel and notch without the flexible seal.
Figure 5:
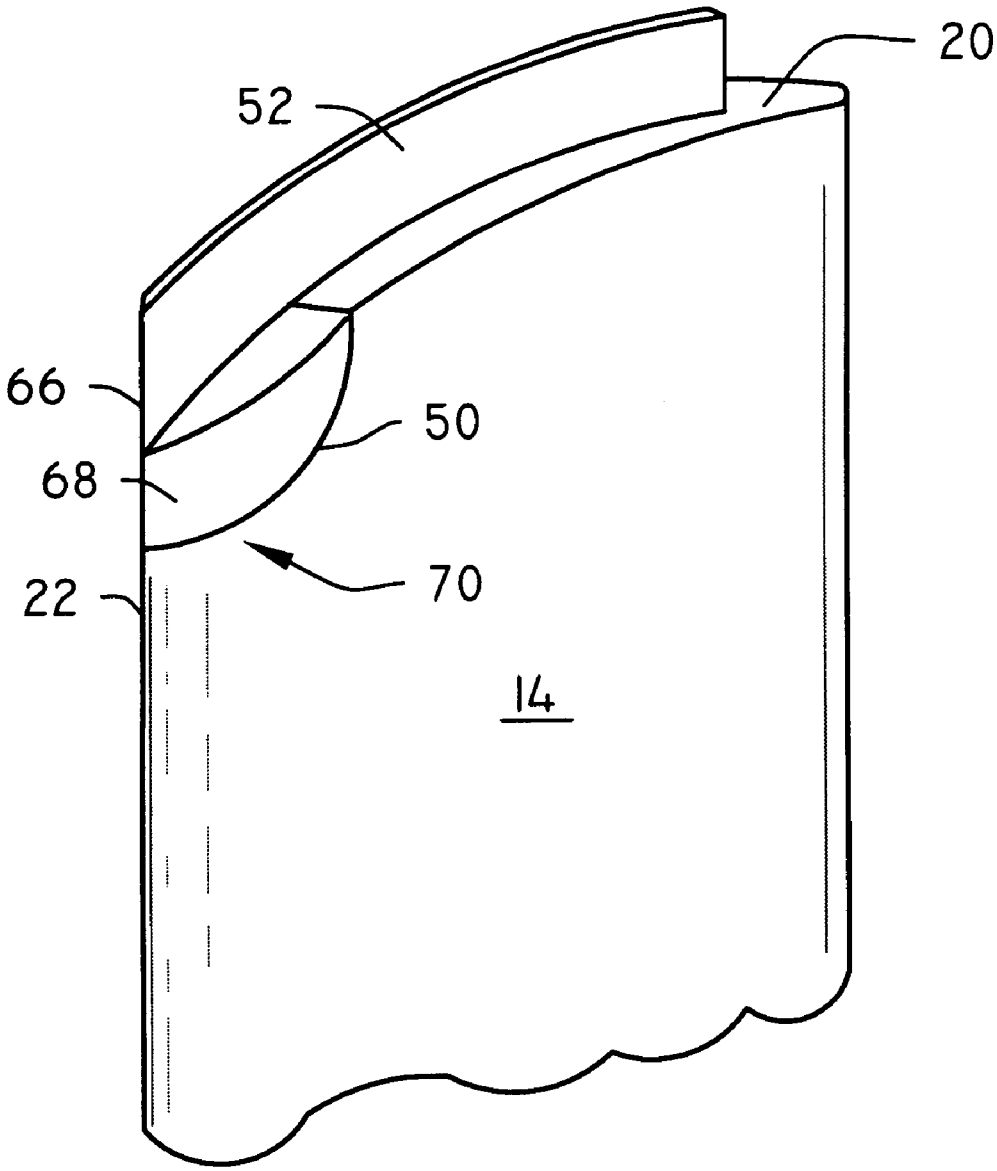
FIG. 5 is the perspective view of FIG. 3 with the flexible seal located in the channel.

As shown in FIG. 3, in the preferred embodiment the airfoil includes a notch 50 adjacent the second end 20, at the leading edge 22 of the airfoil 14, and the channel 28 intersects the notch 50. The channel 28 and notch 50 are preferably cast into the airfoil 14, but may be incorporated by various other means known in the art. A flexible seal 52 is received within the channel 28, thereby connecting the seal 52 to the airfoil 14, as shown in FIG. 4. The seal 52 is made of a material having a substantially lower modulus of elasticity than the material from which the airfoil 14, blade root 12 and blade platform 26 are made, and preferrably the seal 52 is made from a thermal plastic material such as polyetheretherketone (hereinafter referred to as "PEEK").

The seal 52 includes a first layer of fiber 54, such as Kevlar (a registered trademark of DuPont Corporation), and second 56 and third 58 layers of the thermal plastic material. The layer of fiber 54 includes a first seal portion 60 and a second seal portion 62. The first seal portion 60 of the layer of fiber 54 extends from the airfoil 14 in a direction substantially parallel to the axis 16 and is embedded between the second layer 56 and the third layer 58. The second seal portion 62 of the layer of fiber 54 envelopes, and is embedded into, a key 64, and the key 64 is located in the second channel portion 42 immediately adjacent the bottom wall 34. If Kevlar® is used for the fiber, a vacuum press is preferably used to embed the fiber into the key 64 and the second and third layers 56, 58 to prevent the Kevlar® from oxidizing. The key 64 is preferrably made of the same thermal plastic material as the second and third layers 56, 58, and is sized so that there is a slight interference fit between the second seal portion 62 and the first side wall 30, second side wall 32, and bottom wall 34 when the seal 52 is received within the channel 28.

The thickness of the key 64 is substantially larger than the throat 36 of the channel 28, thereby locking the key 64 into the channel 28. As those skilled in the art will readily appreciate, once installed, the seal 52 can only be removed by sliding it out of the channel 28 towards the leading edge 22 of airfoil 14. The tip 66 of the seal 52 extends into the notch 50, and the tip 66 is covered by a cap 68 that is preferrably also made of the same thermal plastic material as the key 64 and the second and third layers 56, 58, and is integral with the key 64 and the second and third layers 56, 58. The cap 68 is contoured to fit snugly into the notch 50, and the cap 68 is also contoured to compliment the contour of the leading edge 22 so that there is a smooth transition from the cap 68 to the airfoil 14 at the edge 70 of the notch 50. Preferrably, the cap 68 is bonded to the airfoil 14 using a toughened epoxy of the type known in the art to be useful for bonding materials with substantially dissimilar coefficients of thermal expansion. In the event the seal 52 becomes worn, or damaged, the seal 52 can be removed by grinding away the cap 68 and sliding the remaining seal 52 toward the leading edge 22 to remove it from the channel 28.

When used in a gas turbine engine, the seal 52 extends into the gap between the second end 20 of the airfoil and the engine case, thereby filling most of the gap during normal engine operation. During conditions such as engine surge, aircraft maneuvers and differences in thermal expansion between the engine rotor and the engine case which decrease the gap, the flexible seal 52 of the blade 10 of the present invention contacts the case and is deflected in the direction of the relative motion of the case to the blade 10. As those skilled in the art will readily appreciate, due to the low modulus of elasticity of the PEEK, and the divergence of the first and second side walls 30, 32 at the second end 20 (which minimizes stress concentrations in the seal 52 during deflections), the flexible seal 52 is able to deflect during these conditions and then return to its original position following cessation of the engine condition which gave rise to the deflection. The fiber embedded in the thermal plastic material holds the plastic material and prevents it from creeping over time.

Figure 6:
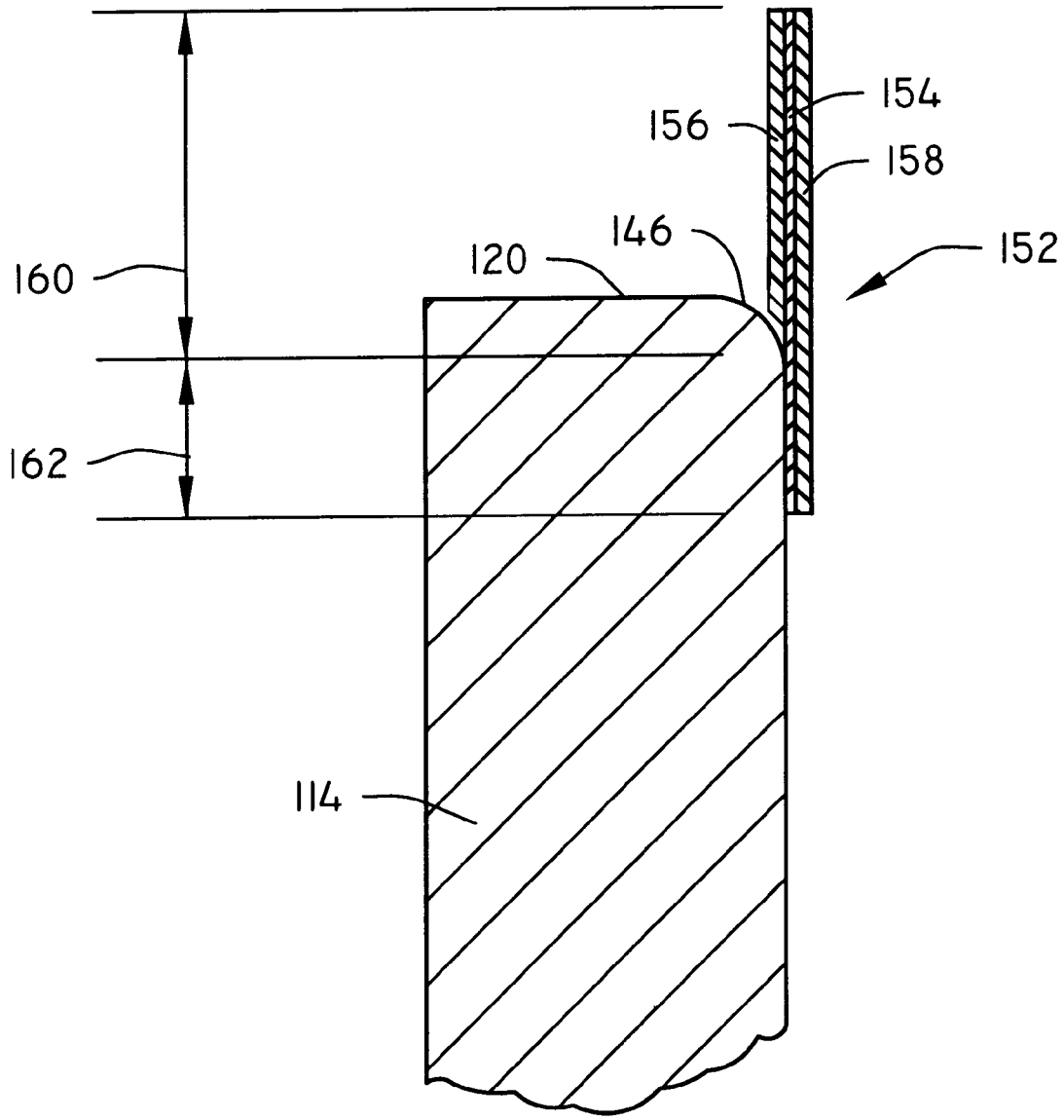
FIG. 6 is a cross-sectional view, similar to FIG. 4, showing an alternate embodiment of the present invention.

An alternate embodiment 100 of the present invention is shown in FIG. 6. In the alternate embodiment, the airfoil 114, blade root 12, and blade platform 26 are the same as disclosed for the preferred embodiment of the present invention, except that the airfoil 114 does not include the channel 28 adjacent the second end 120. The first seal portion 160 of the first layer of fiber 154 is similar to the first seal portion 60 of the preferred embodiment, however, the second seal portion 162 of the layer of fiber 154 is bonded to the airfoil 114 adjacent the second end 120 in the same manner as the cap 68 is bonded to the airfoil 14 in the preferred embodiment above.

The first layer of fiber 154 in the second seal portion 162 is only partially embedded in the third layer 158 of thermal plastic. The partially embedded fiber material interlocks with the thermal plastic and also interlocks with the material used to bond the seal 152 to the airfoil 114. As shown in FIG. 6, the first seal portion 160 of the layer of fiber 154 is sandwiched between, and embedded into, the second and third layers 156, 158 of thermal plastic, and the second seal portion 162 of the layer of fiber 154 is sandwiched between the third layer 158 and the airfoil 114. The second layer 156 terminates adjacent the radiused edge 146 of the airfoil 114, and the second layer 156 tapers toward the layer of fiber 154 immediately adjacent the edge 146. As used in conjunction with the alternate embodiment of the present invention, the term "radiused edge" means that a first surface, such as the airfoil side wall, is connected to a second surface, such as the second end of the airfoil, by a third surface having a radius of curvature that is greater than zero, and preferably, is no less than 25 percent of the combined thickness of the first layer of fiber 154 and the second and third layers 156, 158 of thermal plastic. This design minimizes stress concentrations in the flexible seal 152 in the same manner as the radiused edges 46, 48 do in the preferred embodiment. Preferably, the second portion 162 of the layer of fiber 154 extends from the leading edge of the airfoil 114 to the trailing edge thereof although depending on the particular engine in which the blade 100 of the present invention is to be used, it may be advantageous to have the first seal portion 160 extend only part of that length.

Although this invention has been shown and described with respect to a detailed embodiment thereof, it will be understood by those skilled in the art that various changes in form and detail thereof may be made without departing from the spirit and scope of the claimed invention.

We claim:

1. A blade for use in a gas turbine engine, said blade comprising:

a blade root;

an airfoil having a reference axis defined therethrough, said airfoil extending along said axis and having a first end, and a second end opposite said first end, said second end having at least one edge, and said airfoil is made of a first material having a first modulus of elasticity;

a blade platform connecting said blade root to said first end of said airfoil; and a flexible seal connected to said airfoil adjacent said second end, and said seal is made of a second material having a second modulus of elasticity, said seal having a first layer made of fiber and including a first portion and a second portion, said first portion extends from said airfoil in a direction substantially parallel to said axis and is embedded between a second layer and a third layer, said second portion of said first layer is bonded to said airfoil adjacent said second end said second layer terminates adjacent said edge, said edge is radiused, and said second layer tapers toward said first layer immediately adjacent said edge and said second and third layers of are made of a thermal plastic material;

wherein said second modulus of elasticity is substantially less than said first modulus of elasticity.

2. A blade for use in a gas turbine engine, said blade comprising:

a blade root;

an airfoil having a reference axis defined therethrough, said airfoil extending along said axis and having a first end, and a second end opposite said first end, said second end having at least one edge, and said airfoil is made of a first material having a first modulus of elasticity;

a blade platform connecting said blade root to said first end of said airfoil; and, a flexible seal connected to said airfoil adjacent said second end, and said seal is made of a second material having a second modulus of elasticity, said second modulus of elasticity is substantially less than said first modulus of elasticity, said seal having a first layer made of fiber and including a first portion and a second portion, said first portion extends from said airfoil in a direction substantially parallel to said axis and is embedded between a second layer and a third layer, and said second and third layers of are made of a thermal plastic material;

wherein said airfoil includes a channel adjacent said second end, said channel includes a tapered portion, said tapered portion tapers toward said second end, said channel terminates at said second end at two of said edges, and each of said edges is radiused.

3. The blade of claim 2 wherein said second portion of said first layer envelopes a key, and said key is located in said tapered portion of said channel.

4. The blade of claim 3 wherein said key is made of said thermal plastic material.

5. The blade of claim 4 wherein said airfoil includes a notch adjacent said second end, and said key extends into said notch.

* * * * *